US007344014B2

(12) United States Patent
Takeuchi

(10) Patent No.: US 7,344,014 B2
(45) Date of Patent: Mar. 18, 2008

(54) BANKNOTE STORING WITH CONDITION DETECTION APPARATUS AND METHOD

(75) Inventor: Toru Takeuchi, Iwatsuki (JP)

(73) Assignee: Asahi Seiko Kabushiki Kaisha, Tokyo (JP)

( * ) Notice: Subject to any disclaimer, the term of this patent is extended or adjusted under 35 U.S.C. 154(b) by 539 days.

(21) Appl. No.: 10/797,950

(22) Filed: Mar. 10, 2004

(65) Prior Publication Data

US 2004/0245708 A1 Dec. 9, 2004

(30) Foreign Application Priority Data

Mar. 11, 2003 (JP) ..... 2003-065684

(51) Int. Cl.
*G07F 7/04* (2006.01)

(52) U.S. Cl. ..... 194/207; 194/206; 209/534

(58) Field of Classification Search ..... 194/207, 194/206, 382, 135, 136, 328; 250/556; 209/534; 356/71

See application file for complete search history.

(56) References Cited

U.S. PATENT DOCUMENTS

| | | | | |
|---|---|---|---|---|
| 4,628,194 | A * | 12/1986 | Dobbins et al. | 235/379 |
| 4,880,096 | A * | 11/1989 | Kobayashi et al. | 194/206 |
| 5,101,979 | A | 4/1992 | Uno et al. | |
| 5,419,423 | A * | 5/1995 | Ishida et al. | 194/206 |
| 5,421,443 | A * | 6/1995 | Hatamachi et al. | 194/206 |
| 5,624,017 | A * | 4/1997 | Plesko | 194/207 |
| 5,653,436 | A | 8/1997 | Zouzoulas | |
| 5,657,847 | A * | 8/1997 | Tod et al. | 194/207 |
| 5,756,985 | A | 5/1998 | Holste et al. | 235/475 |
| 5,836,435 | A | 11/1998 | Fujita et al. | 194/206 |
| 5,923,413 | A * | 7/1999 | Laskowski | 356/71 |
| 5,988,345 | A * | 11/1999 | Bergeron et al. | 194/203 |
| 6,044,952 | A * | 4/2000 | Haggerty et al. | 194/207 |
| 6,392,863 | B1 * | 5/2002 | Dunlop et al. | 361/142 |
| 6,435,329 | B1 | 8/2002 | Amari et al. | |

(Continued)

FOREIGN PATENT DOCUMENTS

EP 0 762 344 3/1997

(Continued)

OTHER PUBLICATIONS

Radiation curable acrylate-terminated polymers having polycarbonate repeating units, Jan. 18, 2007, www.freepatentsonline.com, http://www.freepatentsonline.com/6451958.html, p. 1 of 10.*

*Primary Examiner*—Patrick Mackey
*Assistant Examiner*—Gerald W McClain

(57) ABSTRACT

A banknote condition detection device for a banknote storing unit where the banknote storing unit can be removably positioned within a banknote receiving unit. The banknote storing unit receives a banknote from the banknote receiving unit into the banknote storing unit. The received banknote is moved by a moving unit within the banknote storing unit for storing the received banknote within the storing unit. Each of the stored banknotes is aligned together in a stack within the storing unit. The storing unit includes a plurality of optical guide units each having a receiving surface, and each positioned at the surface of the storing unit. A plurality of optical emitter-receiver pair units are positioned within the banknote receiving unit opposite the plurality of optical guide units, each optical emitter-receiver pair unit is positioned to send light to and receive light from a predetermined optical guide unit.

10 Claims, 10 Drawing Sheets

U.S. PATENT DOCUMENTS

| | | | | |
|---|---|---|---|---|
| 6,588,570 | B2 * | 7/2003 | Negishi | 194/207 |
| 6,959,859 | B2 * | 11/2005 | Saltsov et al. | 235/379 |
| 7,007,788 | B2 * | 3/2006 | Dunlop et al. | 194/207 |
| 2001/0011659 | A1 | 8/2001 | Izawa et al. | |

FOREIGN PATENT DOCUMENTS

| | | |
|---|---|---|
| EP | 1 160 738 | 5/2001 |
| WO | 03/013994 | 2/2003 |

* cited by examiner

BANKNOTE STORING WITH CONDITION DETECTION APPARATUS AND METHOD

CROSS-REFERENCE TO RELATED APPLICATION

This application is based on an application number 2003-065684 filed in Japan, dated Mar. 11, 2003.

FIELD OF THE INVENTION

The present invention is related to optical detection within a device, and more particularly to optically detecting the position of a banknote and the status of a banknote storing unit regarding various internal conditions.

DESCRIPTION OF RELATED ART

Traditional banknote storing apparatuses are known. For example, U.S. Pat. No. 5,836,435 to Fujita et al. teaches a bill handling apparatus with a detachable storing unit and a movable lever operative to store banknotes into a storing unit.

For example, a condition detection unit for a banknote storing unit which receives banknotes through a banknote receiving unit is taught by the Japanese Utility Model 2558985 (corresponding to U.S. Pat. No. 5,836,435 granted to Fujita et al.). As taught by Fujita et al., a banknote storing unit is detachable from the banknote receiving unit and includes a movable lever which works together to move the amount of the stored banknotes, and a reflecting board.

The emitted light from the projecting section passes through the air and is received in the receiving section. The small banknote storing unit can be built into a vending machine where is located at outdoors. When the access window is used, dust can enter the banknote storing unit easily. Therefore an operator must clean the reflecting board at frequent intervals. Also, the emitted light diffuses in proportion to distance. Therefore the distance between the projecting and receiving section and the reflecting board is required to be accurately determined.

SUMMARY OF THE INVENTION

The present invention as defined in the claims addresses the limitations of the related art by providing a condition detecting unit which reduces the problems caused by the presence of dust. Secondly, the present invention provides a condition detecting unit for sensing attaching the attachment position of the banknote storing unit. Third, the present invention is economical even when considering an application including multiple detecting units.

In one embodiment, a banknote storing unit with a condition detecting unit includes a banknote storing unit which can be detachably inserted into a banknote receiving unit, and which receives a banknote which is pushed by a moving unit, which is built in the storing unit and can store banknotes in a stack. The condition detecting unit includes a receiving surface and a projecting surface which are located on an optical guide unit and are located at a surface of the banknote storing unit. The projecting and receiving sections are located adjacent to the banknote receiving unit. The optical guide units are also deemed to be optical guide assemblies without regard to their construction as a unit, or a plurality of components.

With this construction, the projecting and receiving surface comprises a portion of a surface of the banknote storing unit. Therefore the distance of the banknote receiving unit side between the projecting surface and the receiving surface can be made very small. When the distance is small, it's difficult for dust to enter. As a result, effects of dust on the projecting and receiving surfaces are reduced. When the dust adheres on the projecting and receiving surface, an operator wipes only one surface, because the projecting and receiving surface structures a surface of the banknote storing unit. As a result, maintenance is easier to perform.

Also, the light which is projected from the banknote receiving unit immediately goes into the receiving surface of the optical guide, afterwards it goes into the receiving surface of the bank note receiving unit from the projecting surface. With this construction, the projecting section and the receiving surface, and the projecting surface and the receiving section can be located in close proximity to each other. Therefore the diffusion of the projected light due to a separating distance is reduced.

Also, the attenuation of the light is drastically reduced since the light that passes through in the optical guide unit is guided by the outer walls of the optical guide unit. Therefore, the inserted or attached position of the banknote storing unit to the banknote receiving unit can be determined. Also, the optical guide unit is fixed at the banknote storing unit as it prevents damage during transport. Therefore when the banknote storing unit is dropped or struck on the way to transport, damage to the optical guide unit is reduced.

Also, the projecting and receiving surface can be located on only one surface of the banknote storing unit. Therefore the electrical components of the projecting and receiving section can be located at one-side of the banknote receiving unit. In other words, the electrical parts referring to the condition detecting unit can be economically located on only one base board. This present invention is desirable because the optical guide includes a detecting projecting surface which faces the detected section in the banknote storing unit and a detecting receiving surface which faces the receiving surface.

With this construction, the emitted light from the projecting section of the banknote receiving unit passes into the optical guide unit through the detecting receiving surface. The received light then passes through the optical guide unit to strike a first internal reflecting surface. The first internal reflecting surface redirects the path of the received light toward a second reflecting surface within the optical guide unit. The second internal reflecting surface redirects the path of the received light in the direction of the banknote receiving unit. The light deflected by the second reflecting surface escapes the optical guide unit at the projecting surface and enters the receiving section of the banknote receiving unit for detection of the received, reflected, and projected light. Therefore the projecting section and the receiving surface, and the projecting surface and the receiving section are located closely to each other. As a result, the diffusion of the light is drastically reduced. Also, the light which passes through the optical guide unit is guided by the outer walls of the optical guide unit. Therefore the attenuation of the light can be drastically reduced.

Therefore the inserted or attached position of the banknote storing unit within the banknote receiving unit can be accurately determined. Also, the condition detecting unit of the banknote storing unit includes machined parts; for example the optical guide, etc. Therefore problems with the condition detecting unit are reduced as it prevents damage during transport. Further, the electrical parts of the projecting and receiving section can be located on only one surface, or one face, of the banknote storing unit. In other words, the electrical parts referring to the condition detecting unit can be mounted on one board resulting in significant cost savings.

This present invention is desirable because the banknote position detecting unit includes a detecting projecting surface and reflector which is located at the side of a banknote moving passageway in the banknote storing unit and is located opposite the banknote moving passageway. In this structure, the light which is received from the receiving surface is guided by the optical guide, and goes to the detecting projecting surface, then it is projected into the banknote passageway from the detecting projecting surface.

The light crosses the banknote passageway and reflects by the reflecting board next crosses the banknote passageway again next goes into the detecting receiving surface, next is guided by the optical guide and goes into the projecting surface, afterwards it goes into the receiving section. Therefore the positions which the light passes through is for example between the projecting section and the receiving surface, between the detecting projecting surface and the ref lector, between the reflector and the detecting receiving surface and between the projecting surface and the receiving section. If the light beam is broken, meaning the light beam is not detected, this indicates a banknote is present at the predetermined position of the banknote passageway indicating a location condition of the banknote at the predetermined position. Accordingly, the distances are very short, and the diffusion of the light is reduced, and the attenuation of the light is reduced drastically. As a result, banknote detecting is accurate.

The present invention is desirable because a standby position detecting unit can be constructed by a detecting projecting surface and a detecting receiving surface which are both of the optical guide which face the standby position of the moving unit in the storing unit. In this structure, the moving unit is located in the banknote storing unit which is movable. The projecting section and the receiving section which detect the standby position of the moving unit is located in the banknote receiving unit.

Also, the projected light from the projecting section is guided by the optical guide which is attached at the banknote storing unit. Therefore the electrical parts; for example, the photo-electrical emitter and sensor do not need to reside on or in the banknote storing unit. As a result, difficulties associated with powering the emitter and receiving the electrical signal from the photo-electrical sensor are avoided. Also, the distance between the projecting section and the receiving section, in other words, the distance which the light passes through in the air is small. Therefore the diffusion of the light is reduced, as a result, it more accurate. This present invention is desirable, because the pushing position detecting unit is structured by a detecting projecting surface and a detecting receiving surface which are both of the optical guide which face the pushed position of the moving unit in the storing unit.

In this structure, the projected light from the projecting section is immediately received into the optical guide through the receiving surface, and goes into the receiving section through the projecting surface. Therefore the distance between the projecting section and the receiving section, in other words, the distance which the light passes through in the air is short. Therefore the diffusion of the light is reduced. And, as a result, the detecting error is reduced or avoided.

This present invention is desirable, because a storing amount detecting unit is structured by a detecting projecting surface and a detecting receiving surface which are both of the optical guide which face the full amount position of the banknotes in the storing unit. With this construction, the light which is projected from the projecting section immediately goes into the optical guide through the receiving surface and passes through the interior section, through the detecting projecting surface, next goes into the optical guide unit again through the detecting receiving surface, next goes into the receiving section from the projecting surface. Therefore the distance between the projecting section and the receiving section, and the distance which the light passes through the air, is short. Therefore the diffusion of the light is reduced, as a result the detecting error is reduced or avoided.

This present invention is desirable, because the optical guide unit is made from an optical resin. In this structure the optical guide can be made up of the integral molding. Therefore when the shape of the optical guide unit is a complex shape, it make up easier better uniformity and inexpensive. Especially, the outside surface of the optical guide is required a function which reflects the light to guide the passing light in the inside. Therefore the outside surface is made up of a mirror finish. When the optical guide is made up of the integral molding, the outer surface of the optical guide is made up of the mirror finish at the molding.

This present invention is desirable because the optical resin can be an acrylate resin. In this structure the acrylate resin does not change color but maintains it's initial coloration over time. Accordingly this present invention does not occur an error based on a changing color of the optical resin. Also the acrylate resin has a hardness which is at predetermined levels. Therefore the frictional wear of the optical guide is little. With this construction, the optical guide is compact in size and inexpensive to make.

This present invention is desirable, because all of the projecting surfaces and the receiving surfaces are located at the surface of the banknote storing unit. With this construction, the receiving surfaces and the projecting surfaces both of the plural optical guides are located at the one surface. Therefore the projecting and receiving sections, which correspond to a portion of the optical guide units, are located at one surface. In other words, the projecting and receiving section can be located on one base board. Accordingly the assembling of the banknote receiving unit is more reliable and economical. Also when the receiving surfaces and projecting surfaces of the optical guide units are cleaned, the operator only need to clean one surface. Therefore the cleaning of the optical guide units is simplified.

This present invention is desirable, because the projecting section includes a light emitting element which is fixed at the upper end of a cylinder which extends perpendicular to the surface of the receiving unit inner wall; the receiving section includes a photo detection or acceptance element which is fixed at the upper end of a cylinder which extends perpendicular. In this structure, the light emitting element and the photo acceptance element are attached at the upper section of the cylinder.

In other words, the light emitting element and the photo acceptance element are located at the upper space which is closed at the upper end. Therefore the rising air current seldom occurs at the upper space. As a result, when the dust goes into the inside of the banknote storing unit, dust seldom adheres on the emitting element and the photo acceptance element. This present invention is desirable, because the projecting section is located at the upper position from the lower surface of the cylinder over the diameter of the cylinder; the receiving section is located at the upper position from the lower surface of the lower surface of the cylinder over the diameter of the cylinder.

In this structure, the emitting element and the photo acceptance element are located vertically upwards as shown in FIGS. 5-10 and are located over the lower surface of the cylinder along the axis of the cylinder.

In an experiment, when the upper end of the space is closed, the rising air current occurs a little at the lower space, however the rising air current does not go into the upper space over the diameter of the cylinder, because the rising air current receive the friction resistance from the around wall. Therefore the dust does not adhere on the emitting element and the photo acceptance element.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the intention is intended to cover alternatives, modifications and equivalents, which may be included within the spirit and scope of the invention as defined by the appended claims.

Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 1:
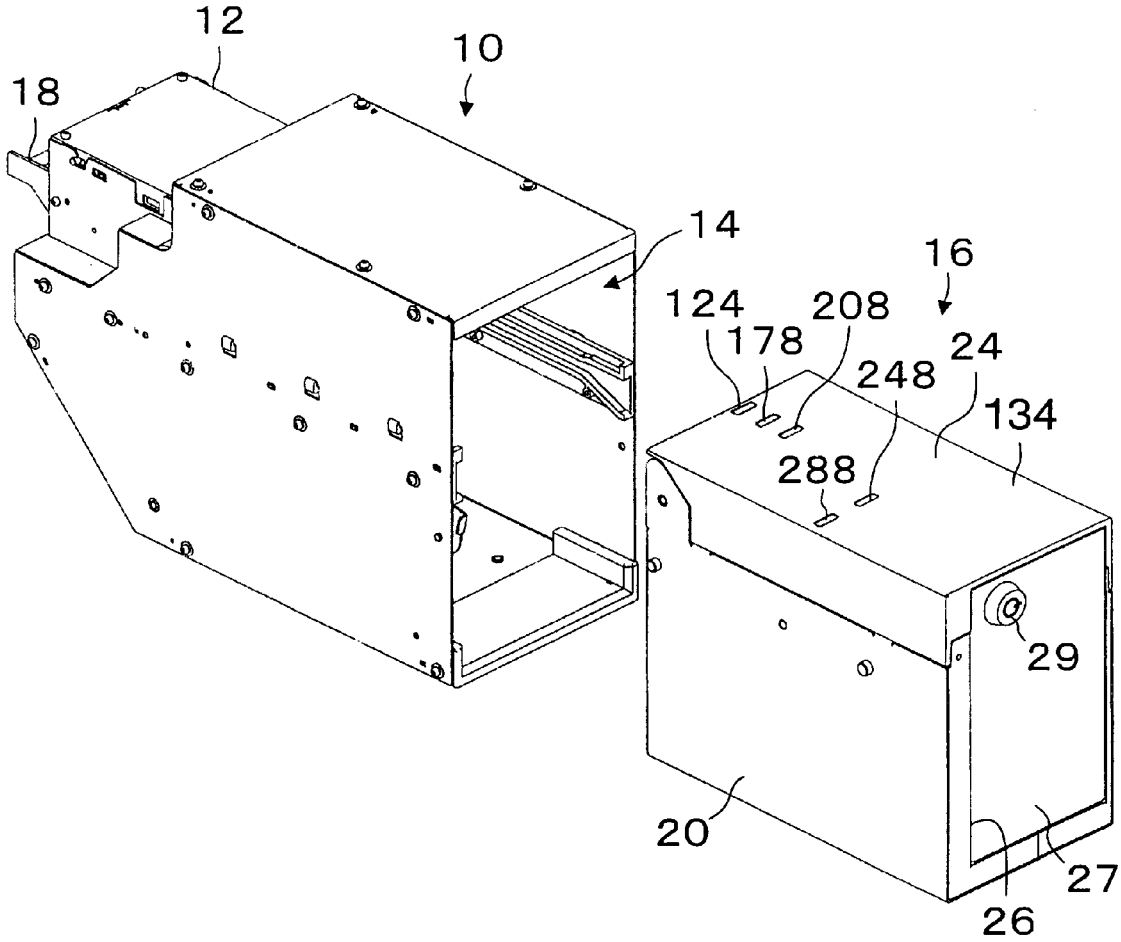
FIG. 1 is a perspective view of the banknote storing unit removed from the banknote receiving unit in accordance with an embodiment of the present invention.

In reference to FIG. 1, the banknote receiving unit 10 includes a banknote accepting unit 12 that is located at the front upper section, and a banknote storing unit 16 that can be inserted into a safe space 14 that is located within the banknote receiving unit 10 and adjacent to the banknote accepting unit 12. The banknote storing unit 16 is secured by a locking unit (not shown). The banknote receiving unit 10 can be positioned within a vending machine, an exchanging machine, or some other machine that receives banknotes from a user. Typically, only the banknote guide 18 of the banknote accepting unit 12 is accessible by a user from the exterior of the machine. The banknote storing unit 16 can refer generally to any enclosed unit for removably inserting into a receiving unit such as the banknote receiving unit 10.

Figure 7:
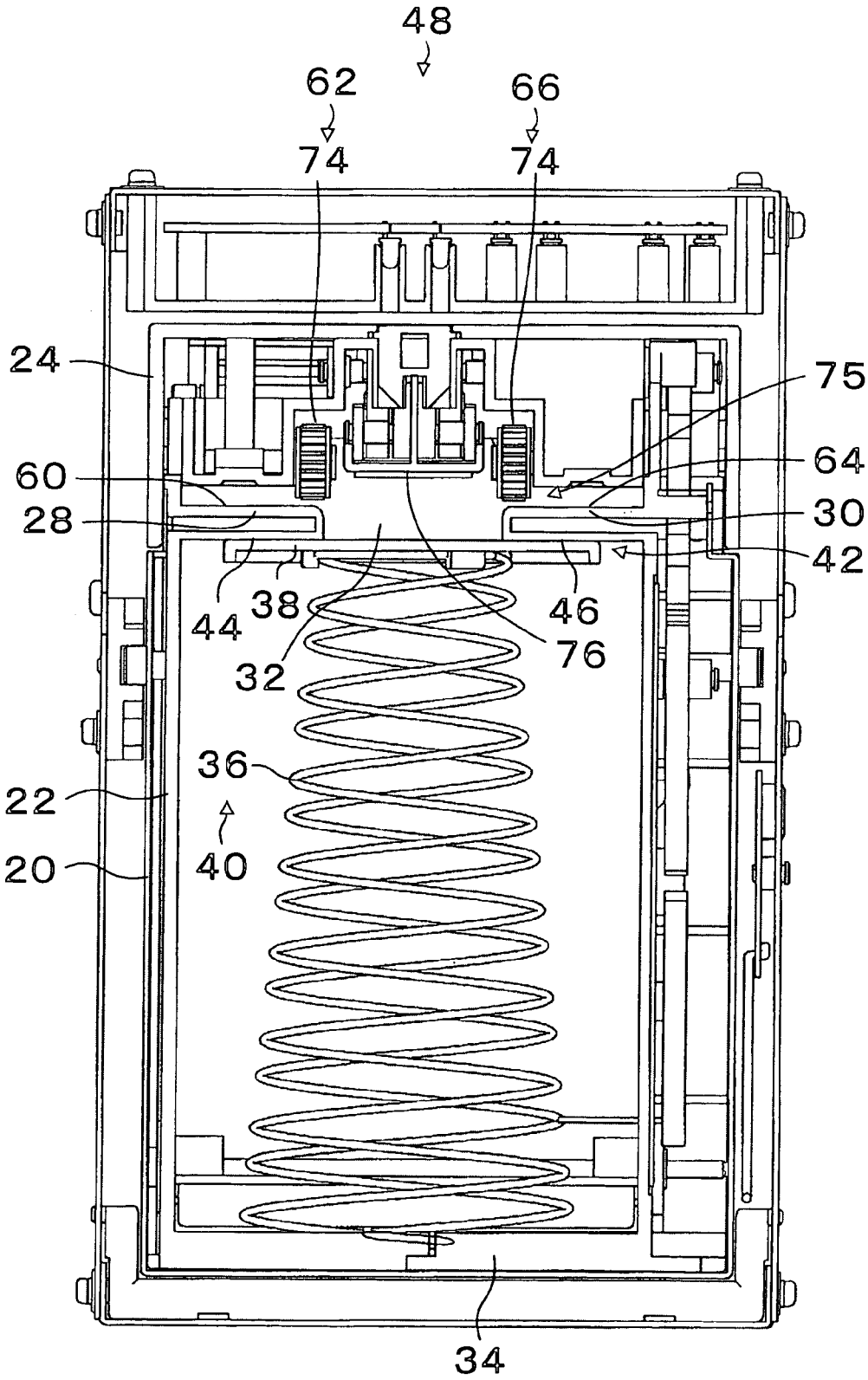
FIG. 7 is a cross sectional view showing the banknote transporting unit in accordance with an embodiment of the present invention.

As shown in FIGS. 1 and 7, the banknote storing unit 16 includes a frame 20 that is typically formed out of sheet metal and is box-like in shape, a storing box 22 that is typically formed from a resinous material, and a storing unit box 24 that is typically formed from a resinous material and is located on the storing unit 16. The storing box 22 fits within the frame 20. The banknote storing unit 16 is generally shaped as an elongated cube.

Next the structure of the storing box 22 is explained (as is mainly shown in FIG. 7). The storing box 22 has an opening at rear side wall 26, the left top board 28 protrudes towards the center from the left side wall, a right top board 30 protrudes towards the center from the right side wall and made up of pushing passageway 32 which extends towards the moving direction and is located between the top boards 28 and 30. A banknote supporting unit 40 is located in the storing box 22 that includes a pair of springs 36 which are fixed at the bottom wall 34 in the storing box 22 and supporting board 38 which is fixed at the upper ends of the springs 36. The banknote storing section 42 is enclosed by supporting board 38, lower surface 44 of left top board 28 and lower surface 46 of right top board 30. The opening of a rear side wall 26 is closed by a lid 27 where the lower section can pivot at the storing box 22 and is locked at storing unit box 24 by locking unit 29.

Figure 4:
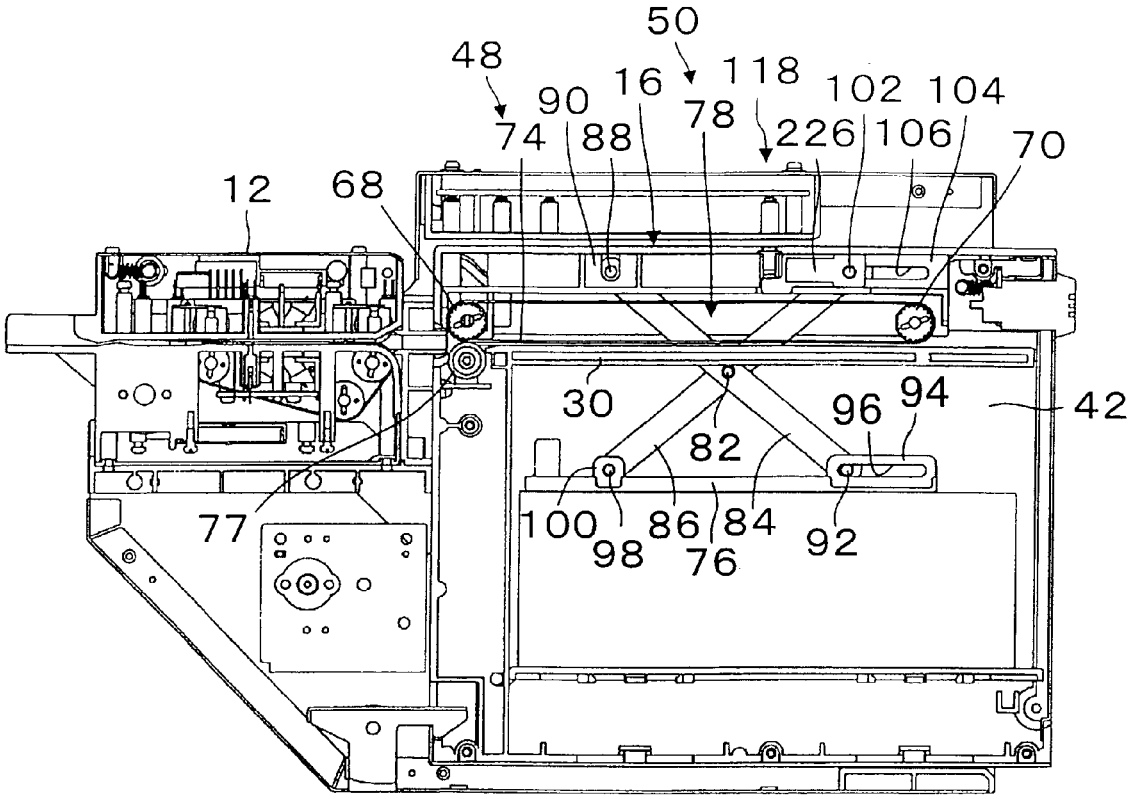
FIG. 4 is a cross sectional view showing the pusher in an activated condition by the banknote moving unit in accordance with an embodiment of the present invention.

Next the structure of the storing unit box 24 is explained (as is mainly shown in FIG. 4). Banknote transporting unit 48 and banknote moving unit 50 are built in storing unit box 24. Downward slanting surface 54 faces to exit 52 of banknote accepting unit 12 and make up of banknote entry 58 together with upward slanting surface 56 of the side of storing box 22. Banknote entry 58 is horn like in shape.

In reference to FIG. 7, the banknote transporting unit 48 is described. The banknote transporting unit 48 includes a left belt unit 62 which faces to a left upper surface 60 of left top board 28 and a right belt unit 66 which faces to right upper surface 64 of right top board 30.

Since a left and right belt unit 62 and 66 are similar in structure, the right belt unit 66 is explained for convenience. A timing belt 74 is put around between a timing pulley 68 which is located relatively to a banknote entry 58 and a timing pulley 70 which is located at the side of lid 27. The under surface of timing belt 74 is located away from the right upper surface 64 at a distance corresponding to the thickness of a banknote. The timing pulley 68 is driven by the motor of banknote accepting unit 12 and rotates in the counterclockwise direction as shown in FIG. 4. Timing belt 74 which is put around between pulley 68 and 70 have contact with right upper surface 64, because it can move away from the right upper surface 64.

The space which enclosed the lower surface of the timing belt 74, a right upper surface 64 and a left upper surface 60 defines a banknote moving passageway 75. Holding roller 77 is located relative to timing pulley 68 at upward slanting surface 56 of storing box 22, and the surface resiliently has contact with timing belt 74. Accordingly, the banknote which is transported from exit 52 is held between the lower surface of timing belt 74 and holding roller 77 and is drawn into the inside of banknote storing unit 16, and is transported by the friction of the under surface of belt 74 at the same time, it is guided by right upper surface 64 and left upper surface 60. Therefore banknote transporting unit 48 has a function which guides the banknote along left top board 28 and right top board 30. The banknote transporting unit 48 can be changed to another type of transport unit that has the same function.

Figure 3:
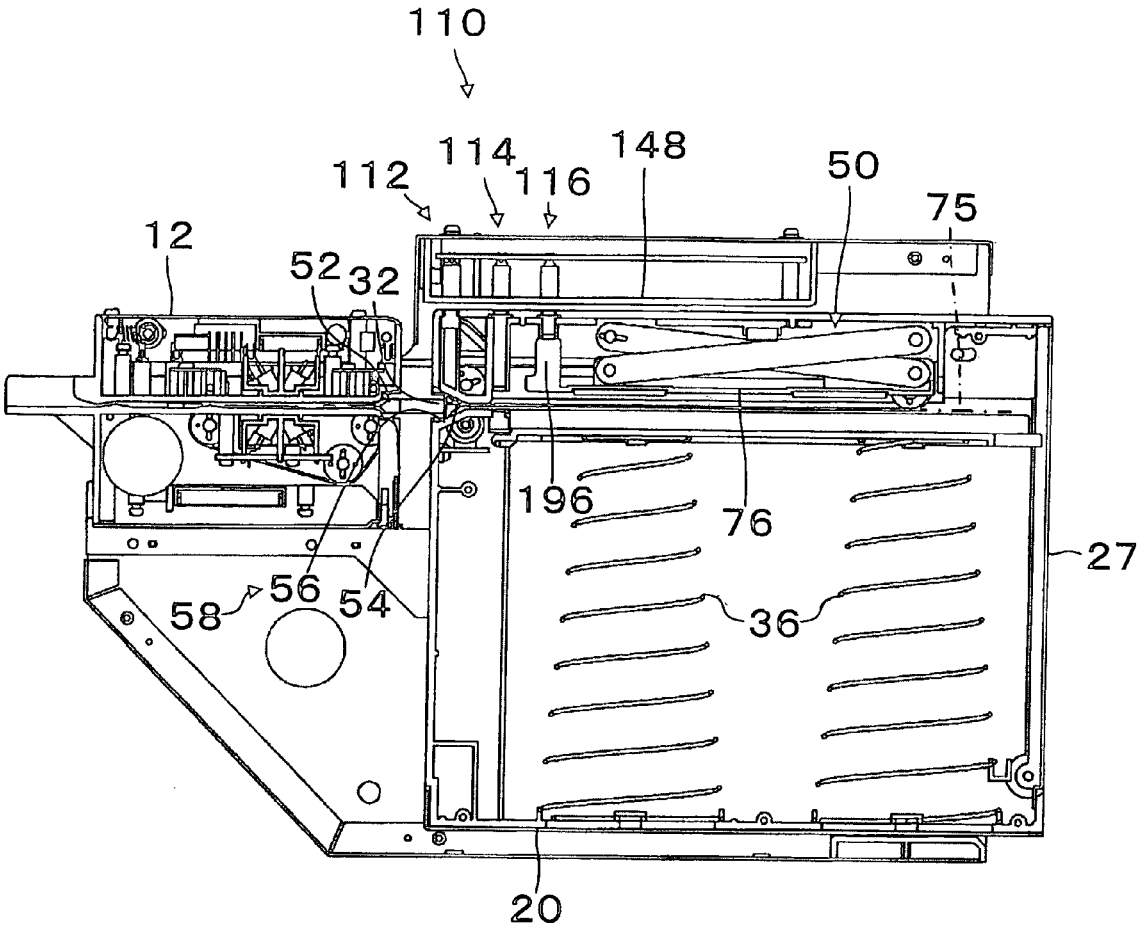
FIG. 3 is a cross sectional view showing the banknote storing unit inserted into the banknote receiving unit in accordance with an embodiment of the present invention.

As shown in FIGS. 3-4, the bank note moving unit 50 is described. A moving unit 50 includes a pusher member 76 which is a plate and is for moving the banknote placed adjacent to the plate. An expanding unit 78 and a driving unit 80 for the expanding unit 78 has a function which moves the pusher member 76 at a predetermined stroke and in a parallel motion. The expanding unit 78 includes a first link 84 and second link 86 which are the same length and can pivot near their midpoints.

Shaft 88 which is fixed at the upper section of first link 84 can pivot on bearing 90 at the under surface of storing box 24. Shaft 92 is located at the lower section and can slide in first guiding groove 96 of first guiding board 94. First guiding groove 96 extends parallel to pusher 76. Shaft 98 which is fixed at the lower section of second link 86 can pivot at bearing 100 which is fixed at the upper surface of pusher 76. Shaft 102 which is fixed at the upper section can slide in guiding hole 103 of second guiding board 104 which is located at the under surface of storing unit box 24. Therefore, when shaft 88 pivots, pusher member 76 is moved upwards and downwards in a parallel motion.

Figure 2:
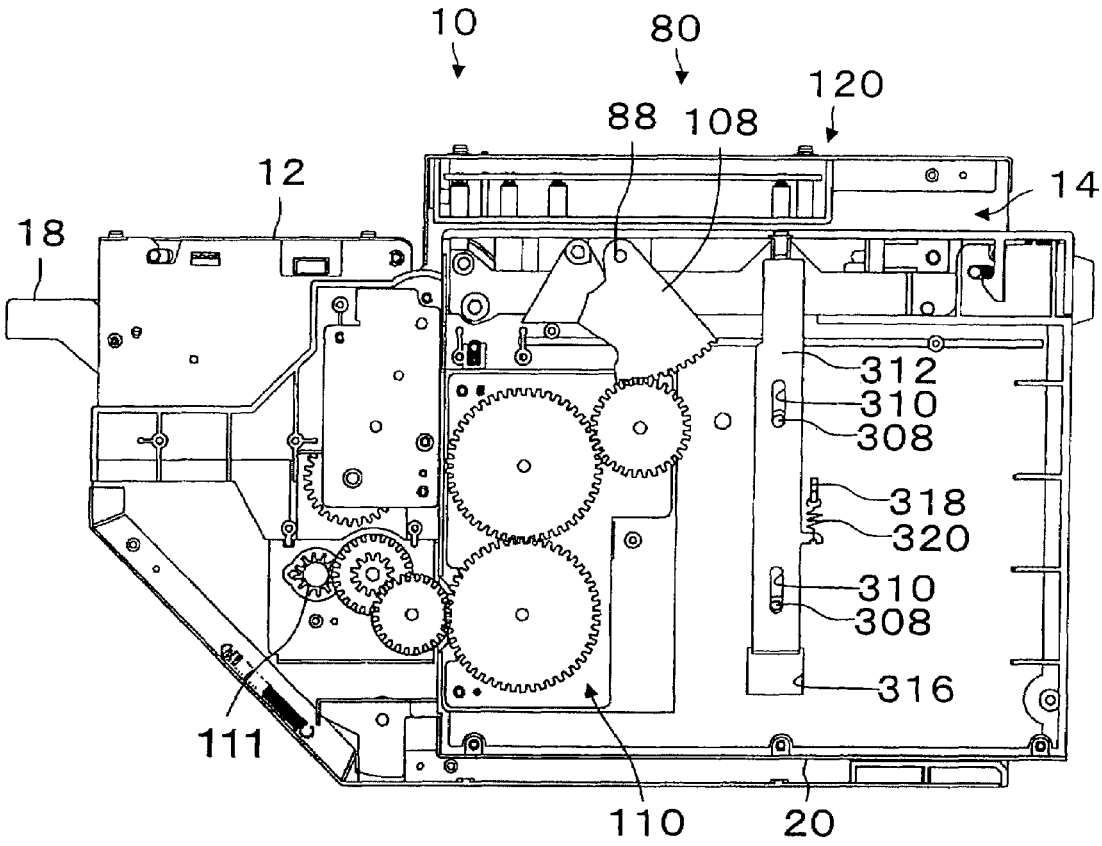
FIG. 2 is a cross sectional view of the driving unit for the banknote moving unit in accordance with an embodiment of the present invention.

In reference to FIG. 2, the driving unit 80 is described. A sector gear 108 is fixed at the left end section of shaft 88 and is engaged with a driving gear 111 which is fixed at the shaft of the driving motor of banknote receiving unit 10 through a reducing gear mechanism. In other words, sector gear 108 pivots in the counterclockwise direction based on the counterclockwise direction of driving gear 111, and pusher member 76 moves upwards. When the pusher 76 moves to the most upper position, the under surface of pusher 76 is located at the opposite side of banknote storing section 42.

In other words, the under surface is located over banknote moving passageway 75. When sector gear 108 pivots in the clockwise direction, pusher 76 crosses banknote moving passageway 75, and goes into banknote storing section 42 through pushing passageway 32, and pushes the supporting board 38 to a predetermined position through the banknote.

Therefore the banknote which is located at banknote moving passageway passes through pushing passageway 32 and is U like in shape, afterwards it goes into banknote storing section 42. When pusher 76 left from banknote storing section 42, the banknote is held between under surface 44, 46 and supporting board 38. In other words, the banknotes are stored in the piled up position.

In reference to FIG. 3, the condition detecting unit 110 is described. In this embodiment, the condition detecting unit 110 includes storing unit position detecting unit 112 which detects the position of the banknote storing unit 16 within the banknote receiving unit 10, banknote position detecting unit 114 which detects a banknote positioned at a banknote moving passageway 75 in the banknote storing unit 16, a standby position detecting unit 116 which detects the standby position of a pusher member 76, a pushed position detecting unit 118 which detects the pushed position of the pusher member 76, and a storing amount detecting unit 120 which detects the condition indicating the banknote storing section 42 is full.

Figure 5:
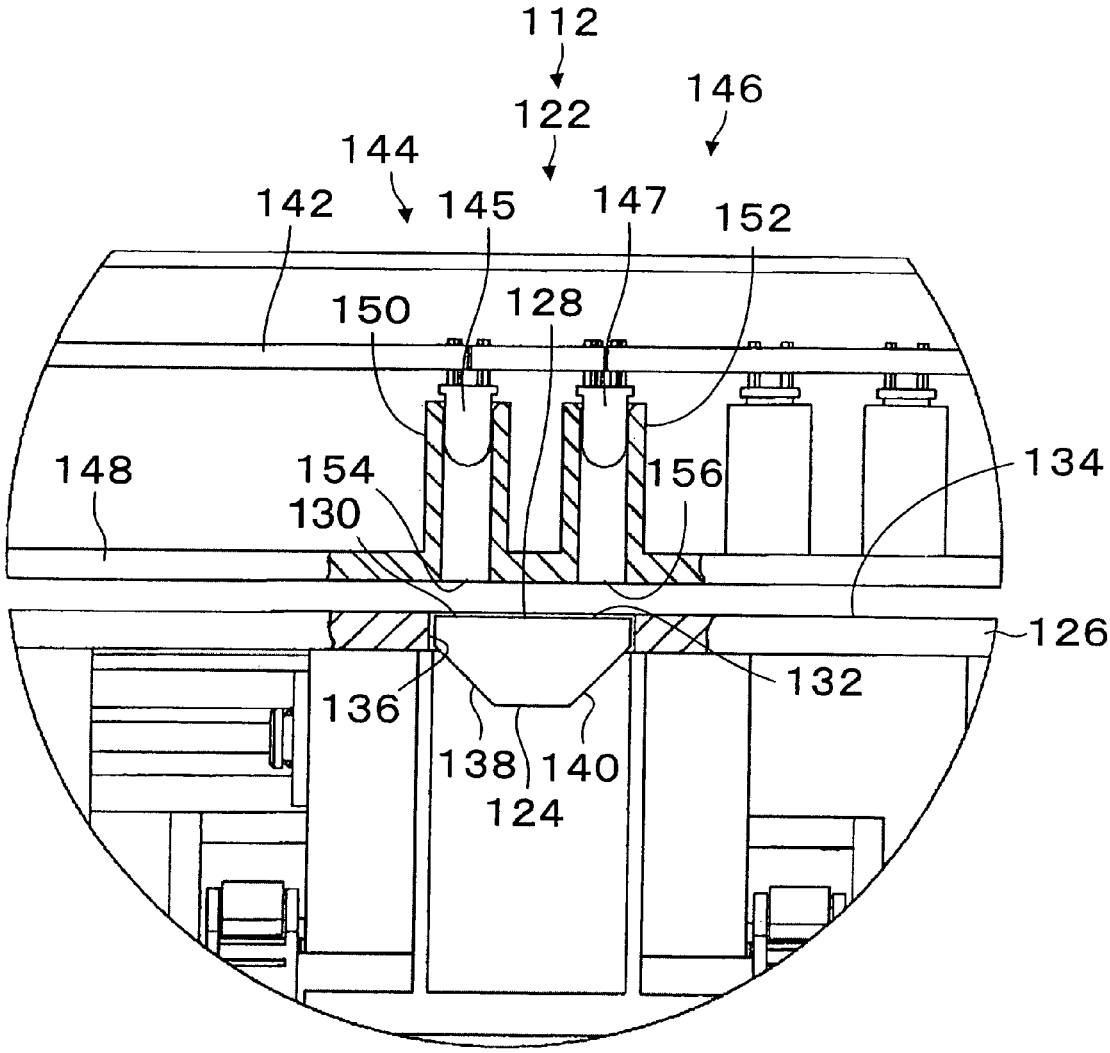
FIG. 5 is a cross sectional view showing the banknote storing unit position detecting unit in accordance with an embodiment of the present invention.

Firstly the storing unit position detecting unit 112 is explained referring to FIGS. 3 and 5. The storing unit position detecting unit 112 includes a projecting and receiving section 122 and storing unit optical guide unit 124. The storing unit optical guide unit 124 is positioned at top board 126 of the storing box 24. In one embodiment, complementary hooks (not shown) of the storing unit optical guide unit 124 mate with hooking surfaces (not shown) of the top board. The receiving surface 128 and projecting surface 132 are located at the upper surface 128.

The upper surface 128 fits into a hole 136 of the top board 126 and is located at the same surface to the upper surface 134. The storing unit optical guide unit 124 is made from a penetrating resin and is in the shape of an inverted trapezoid, and includes a first reflecting surface 138 and a second reflecting surface 140. The first reflecting surface 138 is located under and faces to the receiving surface 130 and crosses to the extending line of receiving surface 130 at 45 degrees. The second reflecting surface 140 is located below the surface and faces to the projecting surface 132 and crosses to the extending line of projecting surface 132 at 45 degrees.

Therefore, the first reflecting surface 138 and second reflecting surface 140 face each other. The wall surface which is around the storing unit optical guide unit 124 is made up of a mirror finish for increasing the internal reflectance within the optical guide unit 124. In other words, when the wall surface of optical guide unit 124 is the mirror finish, the reflectance can get near the total reflection, because the entry angle of the light in the storing unit optical guide unit 124 is smaller.

Therefore the attenuation of the light is prevented drastically. Also, the penetrating resin is an acrylate resin, and is desirable. The acrylate resin is harder than other penetrating resinous materials and can resist abrasion. Therefore, the acrylate resin is suitable to the banknote handling unit. Meanwhile, optical guide 124 can be made up of a optical guide which unifies receiving surface 130 and first reflecting surface 138 and another optical guide which unifies second reflecting surface 140 and projecting surface 132.

When the optical guides are unified as embodiment, the attenuation of the light is prevented and the cost is reduced, because the structuring parts are reduced. Next the projecting and receiving section 122 is explained. The projecting and receiving section 122 is fixed at the upper inside surface of the safe space 14 of the banknote receiving unit 10. The Projecting section 144 and receiving section 146 are fixed on board 142 show a downward tendency and are slightly away from each other. Projecting section 144 includes emitting element 145; for example a light-emitting diode, etc., and a cylinder 150. The receiving section 146 includes a photo acceptance unit 147; for example a phototransistor, etc., and cylinder 152. The projecting and receiving section 122 comprises an optical emitter-receiver pair unit.

Emitting element 145 is inserted into the upper section of cylinder 150 which extends upwards and perpendicular from cover 148 which is located below base 142. Also the position is located over lower opening 154 at a two times the size of the diameter of cylinder 150. Lower section 154 is located right just above receiving surface 130. Photo acceptance element 147 is inserted into cylinder 152. The photo acceptance element 147 is a photo-detection element such as a light sensitive switch that can change state based on the presence or absence of light incident upon the photo-detection element. For example, in the storing unit position detecting unit 112, the presence of light incident upon the acceptance element 147 indicates the true condition that the storing unit 16 is properly positioned within the receiving unit 10.

Lower opening 156 of cylinder 152 is located immediately above the projecting surface 132. When the emitting element 145 and the photo acceptance element 147 are located at the upper sections of cylinders (150, 152) and are located above lower openings (154, 156) at a diameter of the cylinder (150, 152), a rising air current cannot be sustained and does not occur within the cylinders, because the upper openings are closed by the elements (145, 147). Therefore when dust enters into the safe space 14, the dust bearing rising air current does not appreciably contact the emitting element 145 or photo acceptance element 147. As a result, the dust does not adhere on emitting element 145 or photo acceptance element 147. When the raising air current slightly occurs, the current does not enter the mouth of the cylinder much beyond the diameter of the cylinder.

Therefore dust does not adhere on emitting element 145 or photo acceptance element 147. Also, the projecting light from emitting element 145 is reflected by the wall of cylinder 150 and is guided. The emitting light from projecting surface 132 is reflected by the wall of cylinder 152 and is guided. As a result, the diffusion of the light is inhibited. Therefore when storing unit 16 is located at a predetermined position at the safe space 14, the emitting light from emitting element 145 goes in cylinder 150 and goes into receiving surface 130 in an approximately right angle.

The emitting light passes through in optical guide 124, and is reflected by first reflecting surface 138 at approximately a right angle and goes to the side. Next, the light is reflected by the second reflecting surface 140 at approximately a right angle and upward, next the reflected light enters into the cylinder 152 through the projecting surface 132, finally the entering light interacts with the photo acceptance element 147.

Therefore the existence of storing unit 16 can distinguish based on the received light volume of photo acceptance element 147. In other words, when there is no storing unit 16, there is no storing unit optical guide unit 124 to receive and reflect light. Therefore photo detecting element 147 does not receive light, and the positioning of the storing unit 16 within the receiving unit 10 is not detected.

Figure 6:
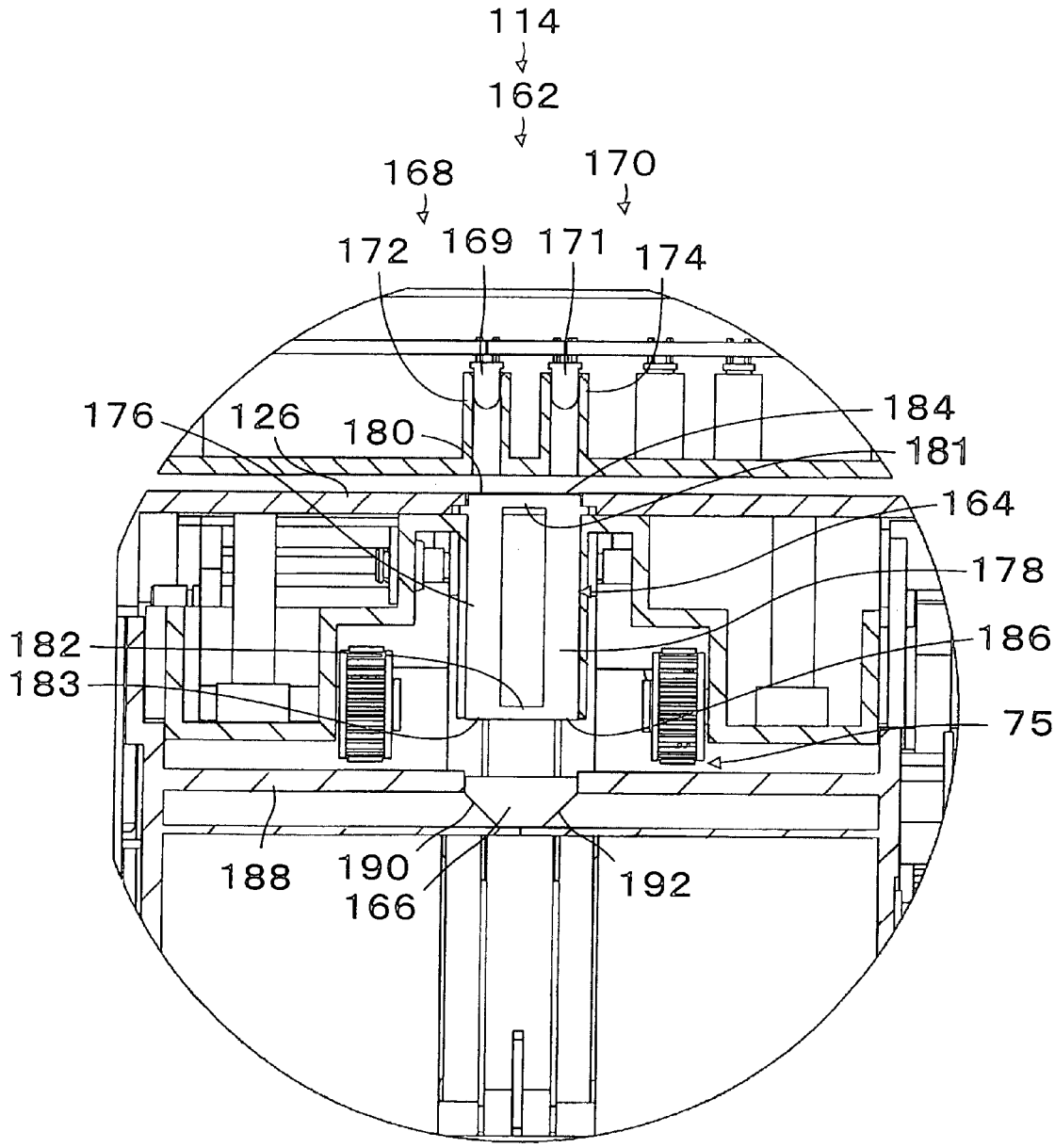
FIG. 6 is an cross sectional view of the banknote position detecting unit in accordance with an embodiment of the present invention.

When the dust adhere on receiving surface 130 and projecting surface 132, the dust is polished by the wiping at upper surface 134, because receiving surface 130 and projecting surface 132 are located on upper surface 134. As a result, the cleaning handling is easy. Next banknote position detecting unit 114 is explained referring to FIG. 6.

Banknote position detecting unit 114 has a function that detects the storing position of a genuine banknote which is distinguished by the banknote accepting unit 12 in storing unit 16. In other words, the trailing end of the received banknote which is accepted into entry 32 is detected by banknote position detecting unit 114. Both the leading edge which interrupts the light beam and the trailing edge which ceases the interruption are detected depending on whether the true condition indicates the presence or absence of the banknote at the predetermined sensor.

Afterwards, the banknote transporting unit 48 is halted to stop the movement of the banknote. Banknote position detecting unit 114 includes a banknote projecting and receiving section 162, a banknote optical guide 164, and a reflector 166. Banknote projecting and receiving section 162 includes projecting section 168 and receiving section 170. Emitting element 169 is inserted into cylinder 172 at projecting section 168. Photo acceptance element 171 is inserted into cylinder 174 at receiving section 170. The banknote projecting and receiving section 162 comprises an optical emitter-receiver pair unit.

Both the structures of projecting section 168 and receiving section 170 are the same as both projecting section 144 and receiving section 146 of storing unit position detecting unit 112. Banknote optical guide 164 is fixed on the reverse of the top board 126 by a bracket (not shown) and faces to the projecting and receiving section 162.

Banknote optical guide 164 includes emitting optical guide 176 which extends perpendicular at right just under the projecting section 168 and receiving optical guide 178 which extents perpendicular at right just under receiving section 170 and are connected by stays (181, 182) and is a rectangular ring shape. When emitting optical guide 176 and receiving optical guide 178 are unified, the number of parts is reduced.

Accordingly the assembling and the cost are better. However emitting optical guide 176 and receiving optical guide 178 can be separated. The upper surface of emitting optical guide 176 is receiving surface 180, and the lower surface is detecting projecting surface 183. The upper surface of emitting optical guide 178 is receiving surface 184, and the lower surface is detecting projecting surface 186.

Detecting projecting surface 183 and detecting projecting surface 186 are located at side by side to the moving direction of the banknote between left belt unit 62 and right belt unit 66 which are located above bank note moving passageway 75 near banknote entry 32. Also, banknote reflector 166 is fixed at banknote guide 188 which is located below banknote moving passageway 75. In other words, the hooks (not shown) of banknote reflector 166 hook into a stair of banknote guide 88. Reflector 166 includes first reflecting surface 190 and second reflecting surface 192 the same as storing unit guide unit 124 reflector.

First reflecting surface 190 faces to detecting projecting surface 183 and second reflecting surface 192 faces to detecting receiving surface 186. Also, first reflecting surface 190 and second reflecting surface 192 are located face to face as the same as the storing unit guide unit 124 reflector.

In this structure, when there is no banknote in banknote moving passageway 75, the emitted light from emitting element 169 goes into projecting optical guide 176 through receiving surface 180, next is guided, next crosses banknote moving passageway 75 through detecting projecting surface 183 and goes into banknote reflector 166, then it is reflected by first reflecting surface 190 towards the lateral, next it is reflected by second reflecting surface 192 upwards, next it crosses banknote moving passageway 75 again, next goes into receiving optical guide 178 and is guided, then it goes into photo acceptance element 171 from projecting surface 184 through cylinder 174.

When there is the banknote in banknote passageway 75, the emitted light from detecting projecting surface 182 is cut off by the banknote. Therefore the light is not received by photo acceptance element 171. Accordingly, when photo acceptance element 171 does not receive the light at a predetermined time, afterwards photo acceptance element 171 received the light again, the situation can be distinguished the trailing end of the banknote below banknote position detecting unit 114. Therefore when the light is re-received, banknote transporting unit 48 is stopped.

Figure 8:
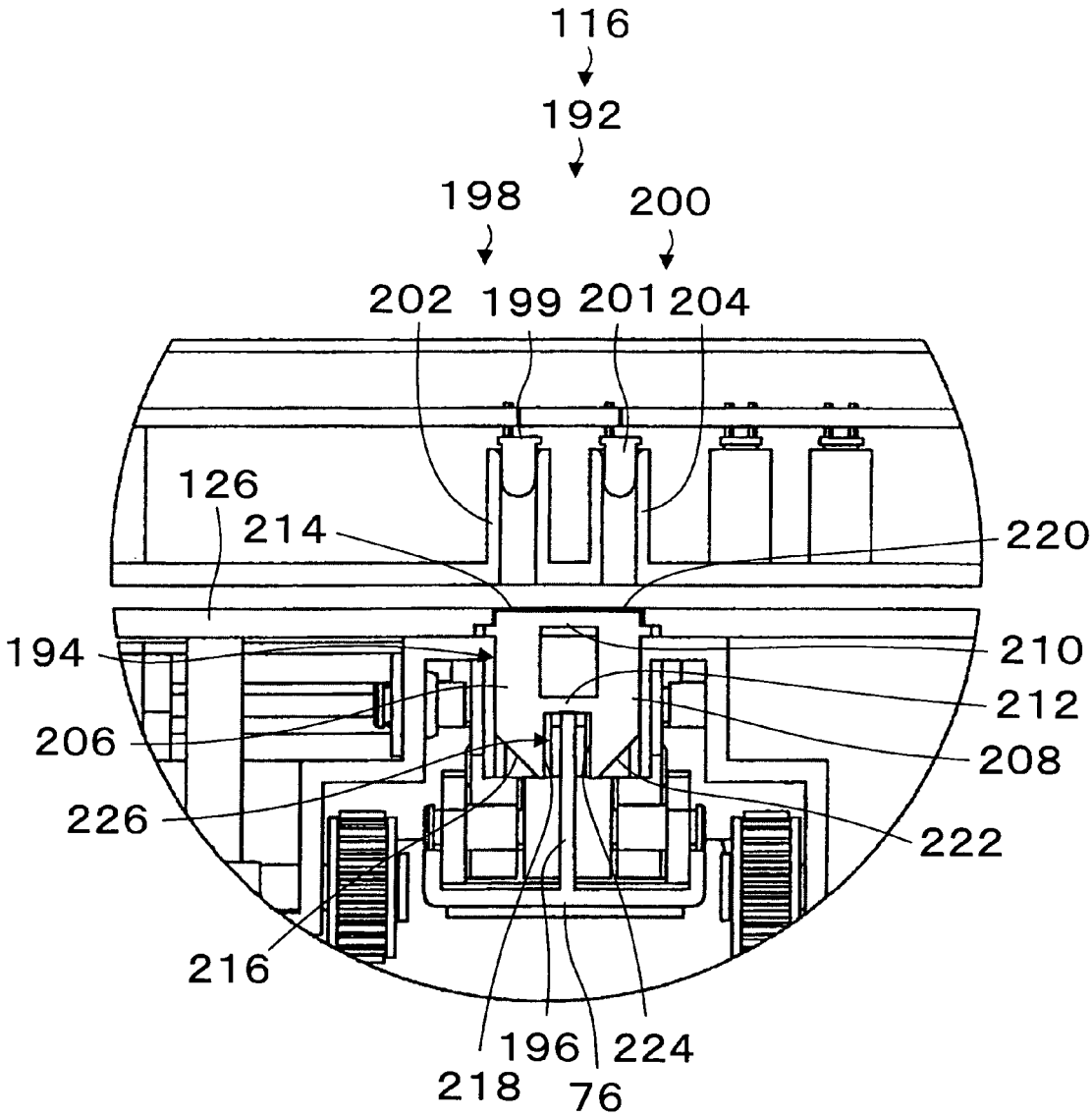
FIG. 8 is a cross sectional view showing the standby detecting unit in accordance with an embodiment of the present invention.

As a result, the banknote is stopped at a suitable position for pushing into storing section 42. Next standby position detecting unit 116 of bank note moving unit 50 is explained referring to FIG. 8. Standby position detecting unit 116 includes standby projecting and receiving section 192, standby optical guide section 194 and standby detecting piece 196. Standby projecting and receiving section 192 includes projecting section 198 and receiving section 200.

Emitting element 199 of projecting section 198 is inserted into cylinder 202. Photo acceptance element 201 of receiving section 200 is inserted into cylinder 204. The projecting and receiving section 192 comprises an optical emitter-receiver pair unit. Both of the structures of projecting section 198 and receiving section 200 are the same as both projecting section 144 and receiving section 146 of storing unit position detecting unit 112. Standby optical guide 194 is fixed at the reverse of top board 126 which faces to projecting and receiving section 192 by a bracket (not shown).

Standby optical guide 194 includes projecting optical guide 206 which extend perpendicular right under projecting section 198 and receiving optical guide 208 which extents perpendicular right under receiving section 200, and are connected by stays 210, 212, and are gate like in shape. When emitting optical guide 206 and receiving optical guide 208 are unified, the number of parts reduces. Accordingly the assembling and the cost are better. However emitting optical guide 196 and receiving optical guide 198 can be separated.

The upper surface of emitting optical guide 196 is receiving surface 214, and reflecting surface 216 slants to the extent line of receiving surface 214 at 45 degrees, and the side surface is detecting projecting surface 218. The upper surface of emitting optical guide 208 is receiving surface 220, and reflecting surface 222 slants to the extent line of receiving surface 220 at 45 degrees, and the side surface is detecting receiving surface 224.

Reflecting surface 216 and reflecting surface 222 are located face to face as the same as storing unit guide unit 124 reflector. Detecting projecting surface 218 and detecting receiving surface 224 are parallel and extent perpendicular, and structure detecting space 226. Detecting space 226 is the access detecting section.

Therefore the light which is emitted from emitting element 199 goes into projecting optical guide 206 through 214, next it is reflected by reflecting surface 216 to the lateral, next it crosses detecting space 226 from detecting projecting surface 218, then it goes into receiving optical guide 208 through detecting receiving surface 224.

The light in receiving optical guide 208 is reflected by reflecting surface 222 upwards, next goes into photo acceptance element 201 through projecting surface 220. Standby detecting piece 196 is fixed at the upper surface of the side of banknote accepting unit 12 of the pusher 76. When pusher 76 is located at the standby position, standby detecting piece 196 is located at detecting space 226, and cuts off the light.

Therefore, when photo acceptance element 201 does not receive the light, pusher member 76 is distinguished in the standby position. When pusher member 76 is detected at the standby position, the motor is stopped. In other words, driving gear 111 is stopped, and pusher 76 is kept at the standby position.

Figure 9:
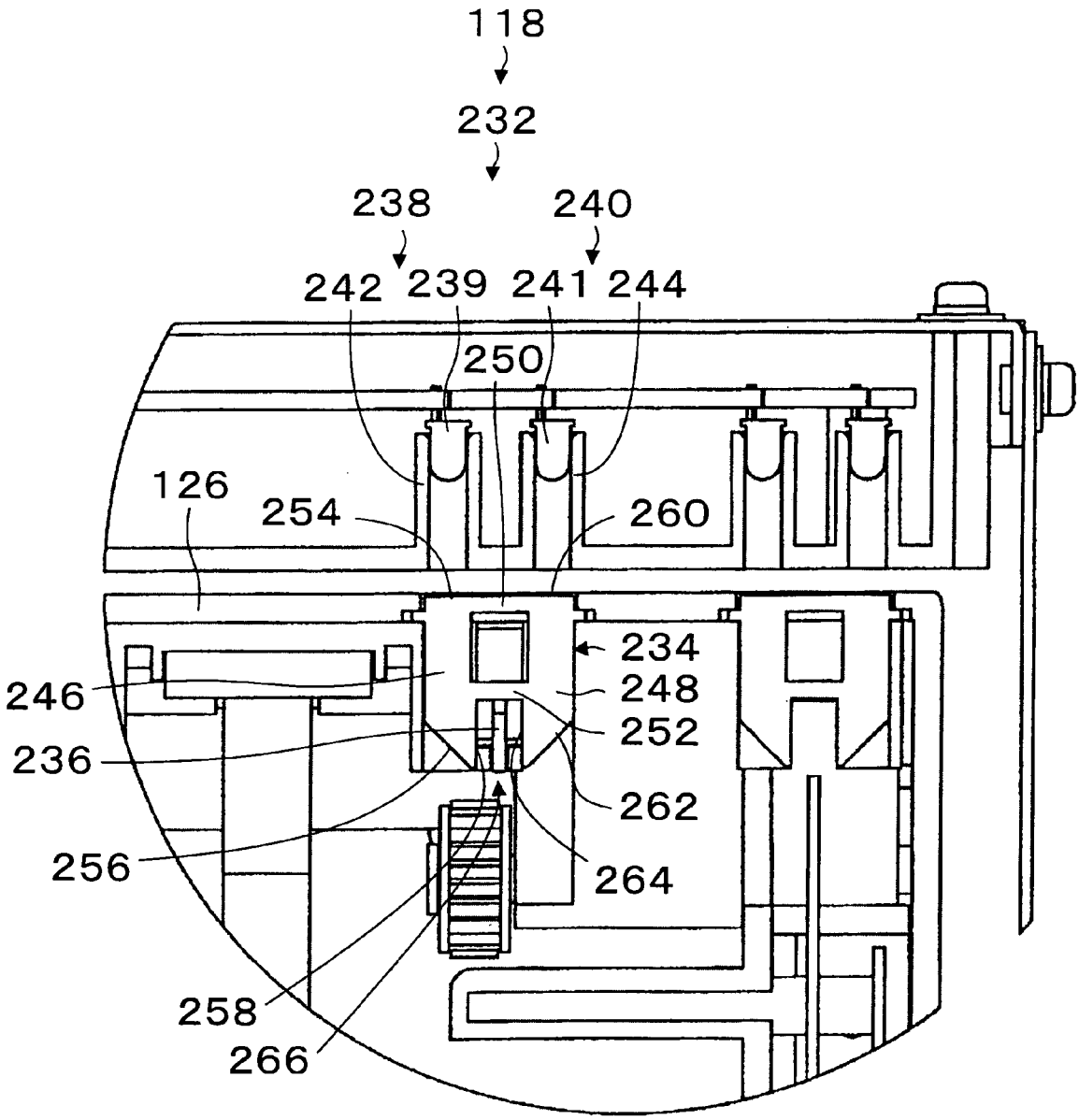
FIG. 9 is a cross sectional view of the moving position detecting unit in accordance with an embodiment of the present invention.

In reference to FIGS. 4 and 9, the moving position detecting unit 118 is described. The moving position detecting unit 118 includes a moving projecting and receiving section 232, a moving optical guide 234, and a moving detecting piece 236. Moving projecting and receiving section 232 includes projecting section 238 and receiving section 240. Emitting element 239 is inserted into cylinder 242 at projecting section 238. Photo acceptance element 241 is inserted into cylinder 244 at receiving section 240. The projecting and receiving section 232 comprises an optical emitter-receiver pair unit. The both structures of projecting section 232 and receiving section 240 are the same as both projecting section 144 and receiving section 146 of storing unit guide unit detecting unit 112.

Moving optical guide 234 is fixed at the reverse of top board 126 by a bracket (not shown) and faces to moving projecting and receiving section 232. Moving optical guide 234 includes projecting optical guide 246 which extend perpendicular right under projecting section 238 and receiving optical guide 248 which extents perpendicular right under receiving section 240, and are connected by stays (250, 252), and it is gate-like in shape. When emitting optical guide 246 and receiving optical guide 248 are unified, the number of parts is reduced. Accordingly the assembling and the cost are better. However emitting optical guide 246 and receiving optical guide 248 can be separated.

The upper surface of emitting optical guide 246 is receiving surface 254, and reflecting surface 256 slants to the extent line of receiving surface 254 at 45 degrees, and the side surface is detecting projecting surface 258. The upper surface of receiving optical guide 248 is receiving surface 260, and reflecting surface 262 slants to the extent line of receiving surface 260 at 45 degrees, and the side surface is detecting receiving surface 264.

The detecting projecting surface 258 and the detecting receiving surface 264 are parallel and extend perpendicular, and structure detecting space 266. Detecting space 266 is the access detecting section. Reflecting surface 256 and reflecting surface 262 are located face to face.

Therefore the light which is emitted from emitting element 199 goes into projecting optical guide 246 through 254, next it is reflected by reflecting surface 256 to the lateral, next it crosses detecting space 266 from detecting projecting surface 258, then it goes into receiving optical guide 248 through detecting receiving surface 264.

The light in receiving optical guide 248 is reflected by reflecting surface 262 upwards, next it goes into photo acceptance element 241 through projecting surface 260. Moving detecting piece 236 is fixed at shaft 102 of expanding and contracting unit 78, and is moved in a body together with pusher 76. When pusher 76 is located at most the moving position (most lower position), moving detecting piece 236 is located at detecting space 266, and cuts off the light.

Therefore when photo acceptance element 241 does not receive the light, pusher 76 is distinguished in the moving position. When pusher 76 is detected at the moving position, the motor is stopped. In other words, driving gear 111 is stopped of the rotation in the clockwise direction, afterwards driving gear 111 is rotated in the counter clockwise direction. Therefore pusher member 76 moves from the moving position to the standby position.

Figure 10:
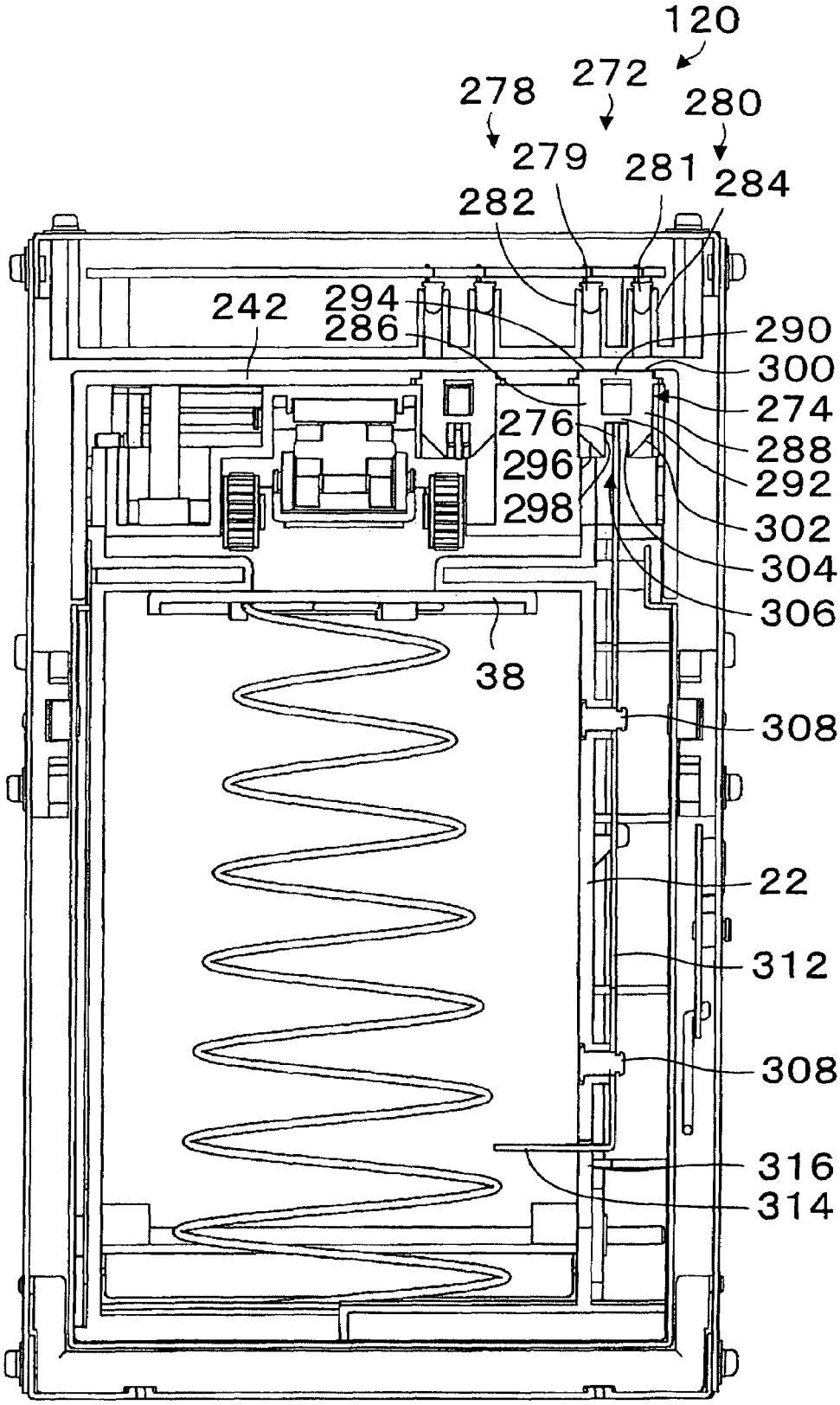
FIG. 10 is a cross sectional view of the storing amount detecting unit in accordance with an embodiment of the present invention.

In reference to FIGS. 2 and 10, the storing amount detecting unit 120 is described. The storing amount detecting unit 120 includes a storing projecting and receiving section 272, a storing optical guide section 274, and a storing detecting piece 276. Storing projecting and receiving section 272 includes projecting section 278 and receiving section 280. Emitting element 279 is inserted into cylinder 282 at projecting section 272. Photo acceptance element 281 is inserted into cylinder 284 at receiving section 280. The projecting and receiving section 272 comprises an optical emitter-receiver pair unit. The both structures of projecting section 278 and receiving section 280 are the same as both projecting section 144 and receiving section 146 of storing unit position detecting unit 112.

Storing optical guide 274 is fixed at the reverse of top board 126 which faces to storing projecting and receiving section 272 by a bracket (not shown). Storing optical guide 274 includes projecting optical guide 286 which extend perpendicular right under projecting section 278 and receiving optical guide 288 which extents perpendicular right under receiving section 280, and are connected by stays (290,292), then it is gate like in shape.

When emitting optical guide 286 and receiving optical guide 288 are unified, the number of parts reduces. Accordingly the assembling and the cost are better. However emitting optical guide 186 and receiving optical guide 188 can be separated. The upper surface of emitting optical guide 286 is receiving surface 294, and reflecting surface 296 slants to the extent line of receiving surface 294 at 45 degrees, and the side surface is detecting projecting surface 298.

The upper surface of emitting optical guide 288 is receiving surface 300, and reflecting surface 302 slants to the extent line of receiving surface 300 at 45 degrees, and the side surface is detecting receiving surface 304. Reflecting surface 296 and reflecting surface 302 are located face to face. Detecting projecting surface 298 and detecting receiving surface 304 are parallel and extent perpendicular, and structure detecting space 306. Detecting space 306 is the access detecting section.

Therefore the light which is emitted from emitting element 279 goes into projecting optical guide 286 through 294, next is reflected by reflecting surface 296 to the lateral, next crosses detecting space 306 from detecting projecting surface 298, next goes into receiving optical guide 288 through detecting receiving surface 304. The light in receiving optical guide 288 is reflected by reflecting surface 302 upwards, next goes into photo acceptance element 281 through projecting surface 300.

Storing detecting piece 276 is made up of the upper section of slider 312 which has elongated hole 310 which is inserted guiding a pair of pins 308 which are fixed at the side wall of the storing unit and located away at a predetermined distance. Lower section 314 of slider 312 bends at a right angle and projects into the storing box 22 through opening 316. As shown in FIG. 2, spring 320 hooks between hook 318 which projects from the side wall of the storing box 22 and slider 312. Therefore slider 312 is urged towards supporting board 38. When the amount of the stored banknotes is under a predetermined amount, slider 312 is moved upwards, and is stopped by guiding pin 308. At the same time, storing detecting piece 276 is located at storing detecting space 306. Therefore the light from emitting element 279 is cut off by the storing detecting piece 276.

When supporting board 38 moves downwards by the stored banknotes, the lower section 314 moves downwards, and storing detecting piece 276 goes out from storing detecting space 306. Therefore when photo acceptance element 281 receives the light, supporting board 38 is distinguished in the full position.

Meanwhile, when the bank note is moved into banknote storing section 42, pusher 76 goes into bank note storing section 42 at a predetermined distance. Accordingly, the distinguishing of the full situation is executed at a timing in which pusher member 76 is located at the moving position. In other words, when moving position detecting unit 118 detects moving detecting piece 226 and storing amount detecting unit 120 does not detect storing detecting piece 276, the full condition of the banknote storage section 42 is indicated.

In addition, the descriptive words such as up, down, left, and right are used for a user's convenience and are not intended to be limiting since the present invention may be practiced with a device positioned with a different orientation than what is shown in the drawings.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. A banknote condition detection device for a banknote storing unit, comprising:

a banknote receiving unit;

a banknote storing unit for being removably positioned within the banknote receiving unit, the banknote storing unit receives a banknote from the banknote receiving unit, the received banknote being pushed by a cam driven flat pusher of a moving unit within the banknote storing unit for storing the received banknote within the banknote storing unit;

a plurality of optical guide units for translating received light having a light projecting surface and a light receiving surface, the light projection surface and the light receiving surface of each optical guide unit being positioned on a surface of the banknote storing unit adjacent the banknote receiving unit when the banknote storing unit is mounted in the banknote receiving unit; and a plurality of optical emitter-receiver pair units disposed within the banknote receiving unit and operatively associated with the plurality of optical guide units, each optical emitter-receiver pair unit includes a light emitting element and a light receiving element being disposed to send light to and receive light from a predetermined optical guide unit in the banknote storing unit.

2. The banknote condition detection device of claim 1, each optical guide unit further comprising:

a detecting projecting surface disposed adjacent to a receiver section of a corresponding optical emitter-receiver pair unit for sending light to the receiver section of the emitter-receiver pair unit; and a detecting receiving surface disposed adjacent to an emitter section of the corresponding optical emitter-receiver pair unit for receiving light from the emitter section of the emitter-receiver pair unit.

3. The banknote condition detection device of claim 2, wherein a predetermined optical guide unit and a predetermined optical emitter-receiver pair unit comprise a storing amount detecting unit including a storing amount optical guide unit and a storing amount emitter-receiver pair unit, the storing amount optical guide unit further comprising:

a detecting projecting surface; and a detecting receiving surface for facing the detecting projecting surface whereby a full amount position of the stored banknotes in the storing unit can be determined when light is blocked between the detecting projecting surface and the detecting viewing surface.

4. The banknote condition detection device of claim 2, wherein the optical guide unit includes a projecting optical guide and a receiving optical guide, the projecting optical guide includes a first reflecting surface, the receiving optical guide includes a second reflecting surface, the first reflecting surface facing the second reflecting surface, wherein a side surface of the projecting optical guide includes the detecting projecting surface while a side surface of the receiving optical guide includes the detecting receiving surface, wherein the optical guide unit includes a light receiving surface on the second end of the projecting optical guide on the end of the projecting optical guide opposite to the first reflecting surface of the projecting optical guide, the optical guide unit includes a light projecting surface on the second end of the receiving optical guide on the end of the receiving optical guide opposite to the second reflecting surface of the receiving optical guide.

5. The banknote condition detection device of claim 1, wherein a predetermined optical guide unit and a predetermined optical emitter-receiver pair unit comprise a position detecting unit including a position detecting optical guide unit and a position detecting emitter-receiver pair unit, the position detecting unit further comprising:

a detecting projecting surface on the position detecting optical guide unit for emitting a light beam received from an emitter section of the position detecting emitter-receiver pair unit; and a reflector member for reflecting the light beam from the detecting projecting surface, the reflector member being disposed adjacent to a banknote moving passageway opposite from the position detecting optical guide unit.

6. The banknote condition detection device of claim 1, wherein the plurality of optical guide units include an optical resin.

7. The banknote condition detection device of claim 6, wherein the optical resin is an acrylate resin.

8. The banknote condition detection device of claim 1, wherein for each of the optical guiding units, the receiving surface and the projecting surface is flush with the surface of the storing unit.

9. The banknote condition detection device of claim 1, each optical emitter-receiver pair unit further comprising:

wherein the emitter of the emitter-receiver pair units further comprises:

a first cylinder having a first end and a second end, the first end of the first cylinder for retaining the light emitting element so that the light emitting element projects light into the first cylinder from the first end to the second end, and wherein the receiver of the emitter-receiver pair units further comprises:

a second cylinder having a first end and a second end, the first end of the second cylinder for retaining the light detecting element so that the light detecting element detects a portion of light admitted into the second cylinder from the second end to the first end.

10. A condition detecting unit of a banknote storing unit comprising:

a banknote storing unit (16) which can be detachable to a banknote receiving unit (10) which receives a banknote which is pushed by a flat pusher (76) of a moving unit (50), wherein the moving unit (50) is built in the storing box and can store banknotes in a pile;

characterized by an optical guide (124, 164, 194, 234, 274), wherein light which passes through the optical guide is guided by the outer walls of the optical guide, the optical guide comprising a light receiving surface (130, 180, 214, 254, 294) and a light projecting surface (130, 180, 214, 254, 294), which are located at a surface (134) of the banknote storing unit (16); and a receiving section (146, 170, 200, 240, 280), including a photo acceptance element (147, 171, 201, 241, 281) and a projecting section (144, 168, 198, 238, 278) including a light emitting element (145, 169, 199, 239, 279) which receiving section and projecting section are located at the banknote receiving unit (10).

* * * * *